US008290195B2

(12) United States Patent
Chick et al.

(10) Patent No.: US 8,290,195 B2
(45) Date of Patent: Oct. 16, 2012

(54) ACOUSTIC RADIATION PATTERN ADJUSTING

(75) Inventors: Geoffrey C. Chick, Norfolk, MA (US); Dewey L. Potter, Holliston, MA (US)

(73) Assignee: Bose Corporation, Framingham, MA (US)

( * ) Notice: Subject to any disclaimer, the term of this patent is extended or adjusted under 35 U.S.C. 154(b) by 295 days.

(21) Appl. No.: 12/751,223

(22) Filed: Mar. 31, 2010

(65) Prior Publication Data

US 2011/0243362 A1 Oct. 6, 2011

(51) Int. Cl.
*H04R 1/02* (2006.01)

(52) U.S. Cl. ..... 381/386; 181/175; 181/176; 181/185

(58) Field of Classification Search ..... 381/386; 181/175, 176, 185
See application file for complete search history.

(56) References Cited

U.S. PATENT DOCUMENTS

| | | | | |
|---|---|---|---|---|
| 3,143,183 | A | 8/1964 | Herbstman | |
| 3,553,392 | A | 1/1971 | Liebscher et al. | |
| 3,735,336 | A | 5/1973 | Long | |
| 4,348,549 | A | 9/1982 | Berlant | |
| 4,496,021 | A | 1/1985 | Berlant | |
| 4,726,444 | A | 2/1988 | Iida et al. | |
| 5,133,018 | A * | 7/1992 | Miyazaki | 381/395 |
| 6,278,787 | B1 | 8/2001 | Azima | |
| 6,704,425 | B1 | 3/2004 | Plummer | |
| 6,904,157 | B2 | 6/2005 | Shima | |
| 7,088,836 | B1 | 8/2006 | Bachmann et al. | |
| 7,252,176 | B2 | 8/2007 | Moore | |
| 7,284,638 | B1 | 10/2007 | Sahyoun | |
| 7,324,656 | B2 * | 1/2008 | Iwayama et al. | 381/386 |
| 7,463,746 | B2 * | 12/2008 | Caron et al. | 381/345 |
| 8,130,994 | B2 * | 3/2012 | Button et al. | 381/339 |
| 2001/0005421 | A1 | 6/2001 | Harris | |
| 2004/0131219 | A1 | 7/2004 | Polk | |
| 2004/0258270 | A1 * | 12/2004 | Shima | 381/396 |
| 2005/0077102 | A1 * | 4/2005 | Banter et al. | 181/149 |
| 2005/0123154 | A1 * | 6/2005 | Kobayashi | 381/152 |
| 2005/0175211 | A1 * | 8/2005 | Suzuki | 381/395 |
| 2007/0014425 | A1 * | 1/2007 | Matsuhashi | 381/386 |
| 2007/0110264 | A1 | 5/2007 | Bachmann et al. | |

FOREIGN PATENT DOCUMENTS

WO 9628949 A1 9/1996

* cited by examiner

*Primary Examiner* — Forrest M Phillips

(57) ABSTRACT

A loudspeaker having an omnidirectional radiation pattern at high frequencies. The loudspeaker includes an acoustic device that includes an acoustic enclosure; an acoustic driver, mounted in the acoustic enclosure; and a sheet of compliant material with a aperture therethrough, mounted in the enclosure, between the acoustic driver and the environment.

20 Claims, 7 Drawing Sheets

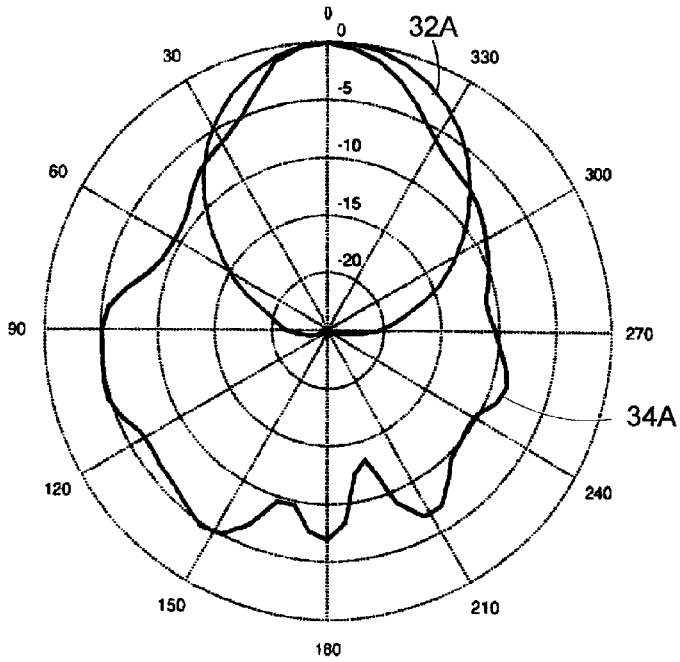
Fig. 6B
Fig. 6C
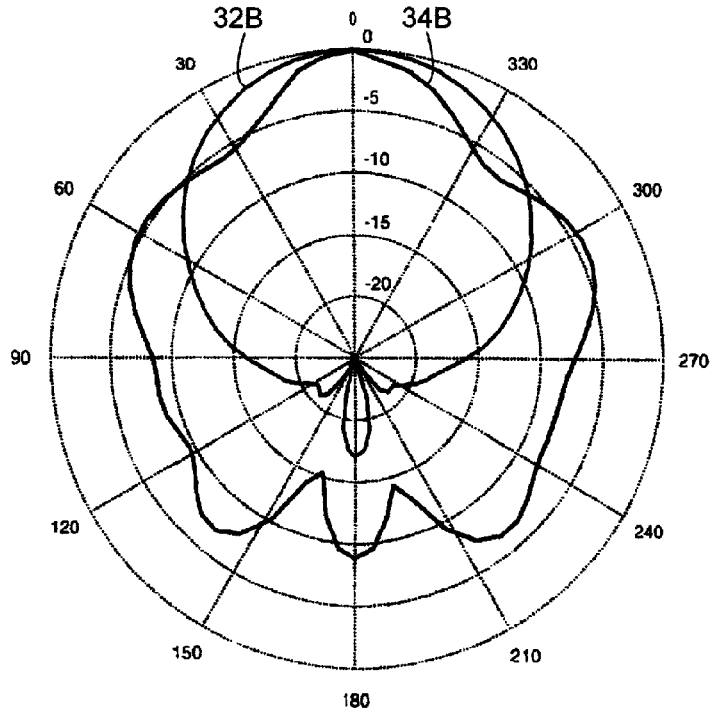

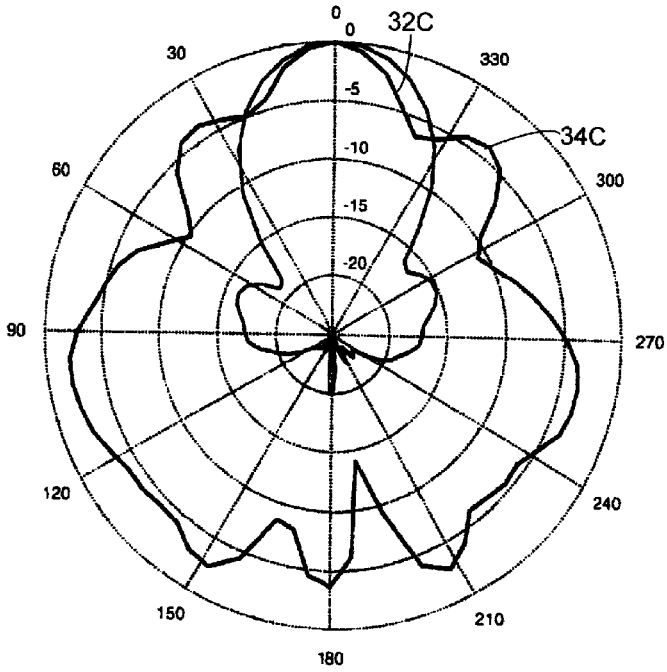
Fig. 6D
Fig. 6E
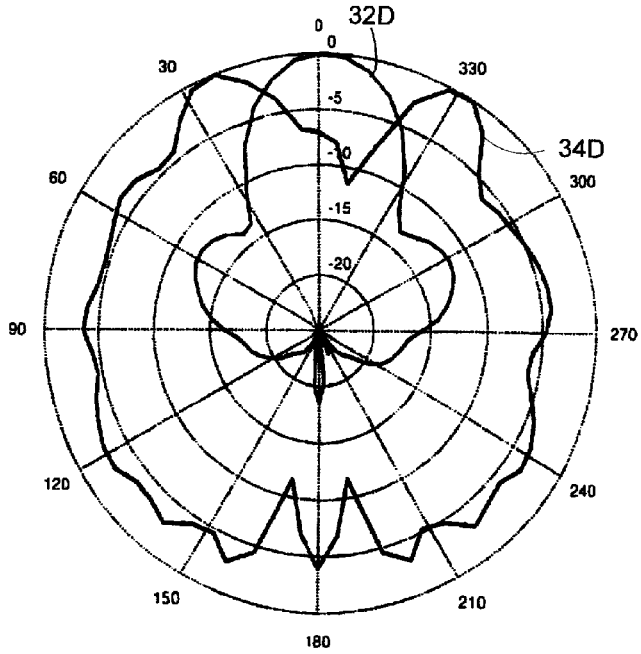

ACOUSTIC RADIATION PATTERN ADJUSTING

BACKGROUND

This specification describes radiation patterns of loudspeakers and for increasing the frequency range in which the loudspeaker has an omnidirectional radiation pattern.

SUMMARY

In one aspect a loudspeaker, includes an acoustic device including an acoustic enclosure; an acoustic driver, mounted in the acoustic enclosure; and a sheet of compliant material with a aperture therethrough, mounted in the enclosure, between the acoustic driver and the environment. The compliant material may be neoprene foam. The sheet may be neoprene foam 0.32 cm (0.125 inches) to 2.54 cm (1 inch) thick. The aperture may be circular and have a diameter of between 1.27 cm and 2.54 cm. The aperture may be non-circular. The aperture may be rectangular. The aperture may be square. The aperture may be a rectangle elongated vertically. The loudspeaker may further include a second acoustic device positioned above the first loudspeaker. The second acoustic device include a second acoustic enclosure; a second acoustic driver, mounted in the second acoustic enclosure; and a second sheet of compliant material with a second aperture therethrough, mounted in the enclosure between the second acoustic driver and the environment, wherein the second aperture is a rectangle elongated vertically. The sheet of compliant material may be dimensioned and configured so that there are open slots between the edge of the sheet and the enclosure through which low frequency acoustic energy can be radiated. The sheet may cause the acoustic driver to radiate proportionately less acoustic energy in the axial direction and proportionately more acoustic energy in off-axis directions than without the sheet. There may be a plurality of apertures through the sheet. The acoustic driver may include a linear motor and a diaphragm, coupled to the linear motor so that the diaphragm vibrates along an axis passing through the aperture. The acoustic driver may include a dust cover having a diameter, wherein the diameter of the aperture is less than the diameter of the dust cover. The sheet may be formed so that the distances from all points on the radiating surface to the sheet measured in a direction parallel to the axis of the acoustic driver are substantially the same. The sheet may have a thickness of less than half of the diameter of the aperture. The loudspeaker may further include an acoustic lens between the sheet and the environment.

In another aspect, an array loudspeaker includes: a plurality of acoustic drivers; a sheet of compliant material having a vertical slot shaped aperture therethrough, between the plurality of acoustic drivers and the environment.

Other features, objects, and advantages will become apparent from the following detailed description, when read in connection with the following drawing, in which:

BRIEF DESCRIPTION OF THE SEVERAL VIEWS OF THE DRAWING

FIGS. 6A-6E are polar plots of a loudspeaker illustrating the effect of a compliant sheet.

DETAILED DESCRIPTION

One method of characterizing the directionality of a loudspeaker is to specify the angle in a plane (typically a horizontal plane) within which the radiation is within some range, for example, −10 dB of the maximum radiation in any direction in the plane. A smaller angle indicates a more directional radiation pattern. A wider angle indicates a less directional radiation pattern. A radiation pattern in which the radiation in all directions is within some range, for example −10 dB, is said to be "omnidirectional". In this specification, the angle within which the radiation is within −10 dB of the maximum radiation in any direction will be referred to as "the −10 dB angle". Other ranges, for example, −6 dB or −12 dB can be used in place of the −10 dB figure.

Figure 1:
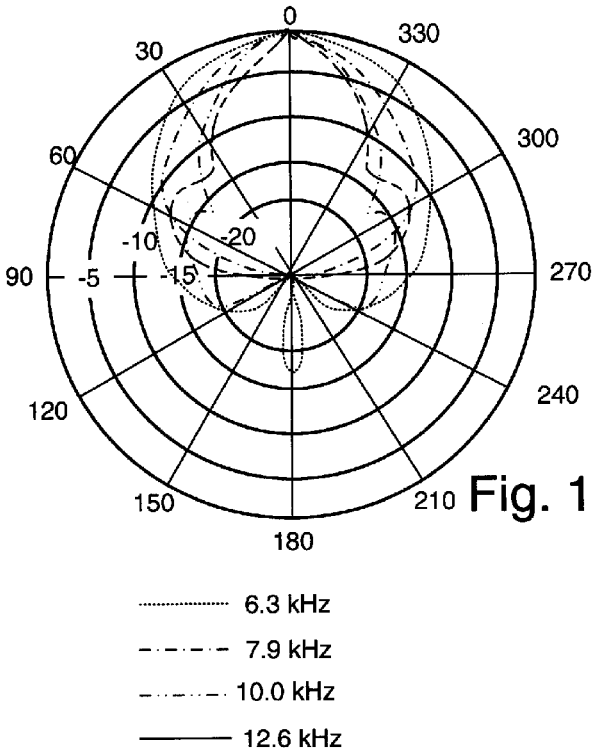
FIG. 1 is a polar plot of the radiation pattern of a loudspeaker.

A characteristic of acoustic drivers is that at wavelengths that are close to or less than the diameter of the radiating surface, the acoustic driver tends to have a more directional radiation pattern than at longer wavelengths. For example, FIG. 1 shows a radiation pattern 10 of a loudspeaker with closed-back 5 cm diameter acoustic driver in an anechoic chamber. The angular measurements are taken from the axis (element 22 of FIG. 2A) of the acoustic driver. At a frequency of 6.3 kHz (5.4 cm wavelength, approximately equal to the diameter of the radiating surface) the −10 dB angle is about 120 degrees; at a frequency of 7.9 kHz (4.3 cm wavelength, approximately 0.85 of the diameter of the radiating surface), the −10 dB angle is about 90 degrees; at a frequency of 10.0 kHz (3.4 cm wavelength, about 0.67 of the diameter of the radiating surface, the −10 dB angle is about 70 degrees; and at a frequency of 12.6 kHz (2.7 cm wavelength, about 0.53 of the diameter of the radiating surface, the −10 dB angle is about 60 degrees. In all cases, the maximum radiation is at or very close to the axis of the acoustic driver.

This increase in directivity is typically undesirable. For example, if the acoustic driver of FIG. 1 were used in a conventional stereo system, there would be much more high frequency energy at some listening positions than at others, while lower frequency acoustic energy would be more equally dispersed. Tuning or equalizing the loudspeaker for one location might result in poor sound quality at another location.

One way of adjusting for the increased directivity at higher frequencies is to provide a second acoustic driver with the radiating surface facing a slightly different direction. However, this is disadvantageous because the radiation pattern of the combined two acoustic drivers may have prominent lobes and dips due, for example, to interaction between radiation of the acoustic drivers. Another approach is to use smaller diameter acoustic drivers for the high frequencies ("tweeters"), but this also requires additional acoustic drivers and crossover networks.

Another way of adjusting for the increase directivity at higher frequencies is to alter the radiation pattern of the loudspeaker so that proportionately less acoustic energy is radiated on-axis and proportionately more acoustic energy is radiated off-axis. One way of altering the radiation pattern of a loudspeaker is to use a device such as a diverging acoustic lens, for example as described in Olson, *Acoustical Engineering published in* 1991 by Professional Audio Journals, Inc., Philadelphia Pa., pages 19-20.

Figure 2B:
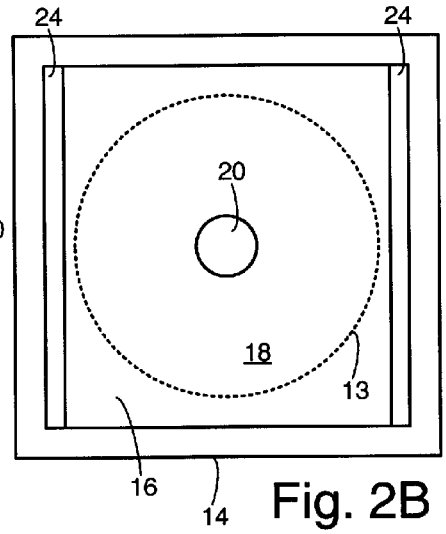
FIGS. 2A and 2B are diagrammatic views of a loudspeaker.
Figure 2A:
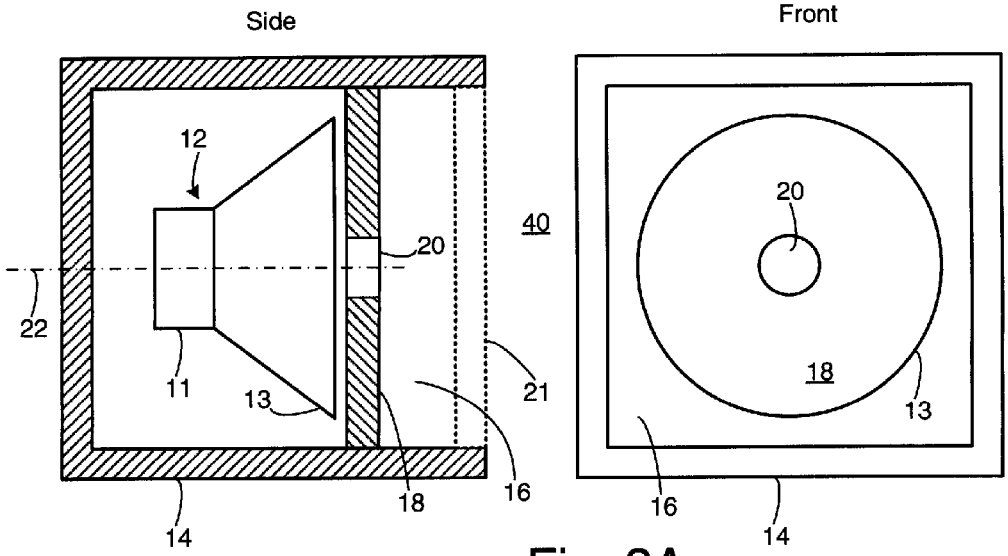

FIG. 2A shows a loudspeaker arrangement that alters the radiation pattern of an acoustic driver so that less acoustic energy is radiated on-axis and more acoustic energy is radiated off-axis without the need for devices such as acoustic lenses. The loudspeaker arrangement includes an acoustic driver 12 having a linear motor 11 coupled to a radiating diaphragm 13, in this case a cone-shaped diaphragm, so that the motor causes the diaphragm to vibrate along an axis 22 passing through the center of the radiating surface and extending in a direction parallel to the intended direction of motion of the diaphragm, thereby radiating acoustic energy. The acoustic driver may be mounted in a closed-back enclosure 14. Between the diaphragm and the environment 40, in this case, an open side 16 of the enclosure 14, is a sheet 18 of compliant, non-acoustically transparent material with a aperture 20 therethrough. The open side 16 of the enclosure 14 may be covered with an acoustically transparent grille 21, or an acoustic lens 21. The acoustic lens may be positioned so that it contacts the sheet. The grille or grille will be omitted from the remainder of the drawings.

In one implementation, the acoustic driver 12 is a 5 cm cone type driver. The enclosure 14 is 66 mm from side to side, 83 mm from front to back, and 56 mm from top to bottom. The sheet 18 is made of closed cell neoprene foam, 3 mm thick, with a round aperture with a diameter of about 1.2 cm, positioned approximately at the center of the sheet so that the axis 22 of the acoustic driver is approximately lined up with the center of the aperture 20. The sheet 18 is positioned 3 mm from any moving portion of the acoustic driver (which may be the surround, not shown in this view) of the acoustic driver. In other implementations, the sheets may be made of closed cell foams of other materials; felts or fabrics; or other compliant, non-acoustically transparent materials; generally, closed-cell foam provide the best results.

The sheet should be sufficiently compliant to dampen any standing waves that may form in the space between the radiating surface and the sheet and so that pressure does not build up in the volume between the radiating surface and the sheet. The sheet should have sufficient acoustic opacity to prevent substantial high frequency energy from radiating through the material; the sheet should absorb as little low frequency radiation as possible; and the sheet should be formable and should retain its shape and geometry. The desirable characteristics may be obtained by material selection, by geometry of the sheet, or by both. Pressure buildup between the acoustic driver and the sheet is undesirable. If there is a pressure buildup in the volume between the radiating surface and the sheet may be alleviated by using a more compliant material, by using a thinner sheet of material, or both. The sheet should be sufficiently compliant to dampen any standing waves that may form in the space between the radiating surface and the sheet and so that pressure does not build up in the volume between the radiating surface and the sheet. The sheet should have sufficient acoustic opacity to prevent substantial high frequency energy from radiating through the material; the sheet should absorb as little low frequency radiation as possible; and the sheet should be formable and should retain its shape and geometry. The desirable characteristics may be obtained by material selection, by geometry of the sheet, or by both. Pressure buildup between the acoustic driver and the sheet is undesirable. If there is a pressure buildup in the volume between the radiating surface and the sheet, it may be alleviated by using a more compliant material, by using a thinner sheet of material, or both. Sheets of material having compliances of $3.348\times10^{-4}$ m/N and $3.723\times10^{-4}$ m/N (when 13 mm disks 3 mm to 6 mm thick are subjected to a simple stress/strain test) have been found to be suitable. By contrast, hard plastics have substantially lower compliances, for example around $0.01490\times10^{-4}$ m/N under similar conditions, more than two orders of magnitude less than the compliance of the compliant sheets. Also, sheets of material having compliances significantly greater than $3\times10^{-4}$ m/N m, for example, conventional open cell foams may not have sufficient acoustic opacity to prevent substantial high frequency energy from radiating through the material or to retain its shape and geometry.

For best results, the thickness of the sheet should be equal to or less than the diameter of the hole. Omnidirectionality to higher frequencies can be obtained with circular aperture diameters from 1.27 cm (0.5 inches) to 2.54 cm (1 inch) and sheet thicknesses of 0.32 cm (0.125 inches) to 2.54 cm (1 inch) of neoprene foam. Generally, larger aperture diameters result in greater sensitivity, while smaller aperture diameters result in omnidirectionality to higher frequencies.

In the embodiment of FIG. 2B, the sheet 18 is narrower than the opening of the enclosure 14 so that there are vertical slots 24 at the left and right sides of the opening 16 that are not covered by the sheet 18. In one embodiment, the vertical slots are 3 mm wide and 50 mm high. In other implementations the slots may be horizontal slots at the top and bottom of the enclosure, or on all sides. The slots should be positioned and dimensioned so that little high frequency acoustic energy radiates through the slots but so that low frequency acoustic energy does radiate through the slots. One way of reducing the amount of high frequency energy that radiates through the slots while not appreciably reducing the amount of low frequency acoustic energy that radiates through the slots is to put small amounts of a damping material such as small amount of acoustically absorbent material such as fiberglass or polyester in the slot. Another way is to make the vertical and horizontal dimensions of the sheet of compliant material (and the enclosure if necessary) substantially larger than the diameter of the acoustic driver. Still another way is, if the sheet is smaller than the opening, using a wider and/or longer sheet.

The distance between the radiating surface 13 of the acoustic driver 12 to the sheet 18 should be less than the diameter of the aperture 20. Preferably, sheet 18 should be as close to the radiating surface 13 as possible, without contacting the radiating surface at maximum excursion. One result of placing the sheet as close as possible to the radiating surface is that standing waves that may occur are likely to have a wavelength and corresponding frequency that is out of the range of operation of the acoustic driver or are easily damped.

Figure 3A:
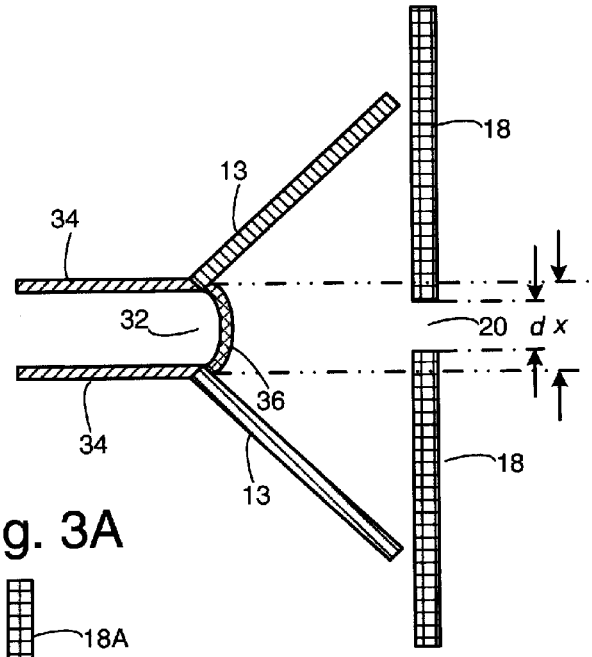
FIGS. 3A and 3B are diagrammatic cross-sections of a loudspeaker.
Figure 3B:
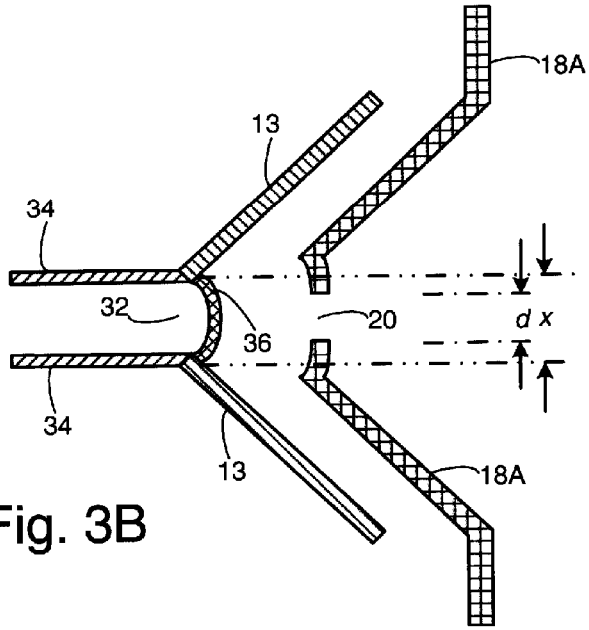

FIGS. 3A and 3B show cross-sections of some of the elements of FIGS. 2A and 2B showing additional features and variations of the sheet 18. In FIGS. 3A and 3B, some dimensions are exaggerated for the purpose of illustration and some elements of other figures are omitted for the purpose of clarity. In FIGS. 3A and 3B, the cone-shaped radiating surfaces 13 have a central opening 32 that is joined to a voice coil former 34 around which is wound a voice coil, not shown in this view. The opening 32 in the radiating surface is closed by a dust cover 36. In FIG. 3A, the diameter d of the aperture 20 in the sheet 18A is less than the diameter x of the dust cover 36. Similarly, in FIG. 3B, the diameter d of the aperture 20 in the sheet 18A is less than the diameter x of the dust cover 36. The dust cover 36 may be approximately the same diameter as the central opening 32 as shown, or may be significantly larger. In addition, in FIG. 3B, the sheet 18B is shaped, so that the vertical cross section including the axis 22 taken of the sheet 18B is similar to the corresponding cross-section of the radiating surface 13A and the dust cover 36, so that the distance from all points on the radiating surface 13A to the sheet 18A measured in a direction parallel to the axis 22, is substantially the same and so that the volume of air between the radiating surface 13A (and dust cover 36) and the sheet 18A and the is minimized. Shaping the sheet as shown in FIG. 2C enables the sheet to be even closer to the radiating surface.

In one implementation, the aperture 20 has a diameter of about 1.2 cm, which is approximately equal to the wavelength corresponding to a wavelength of 20 kHz, which is above the range of operation of most acoustic drivers and above the range of frequencies to which most human ears respond. One consequence of an aperture is that for directionality purposes, the diameter of the effective radiating surface may approach the diameter of the aperture. Therefore, if the arrangement of FIGS. 2A, 2B, 3A, and 3B become directional, the frequency at which a more directional radiation pattern occurs is near or above the upper limit of the frequency range to which most human ears respond. However, the total amount of radiation produced related to the actual area of the radiating surface, so that the total amount of radiation is more than if the high frequency acoustic energy were radiated by an acoustic driver with a diameter of 1.2 cm, the diameter of the aperture 20.

Figure 4A:
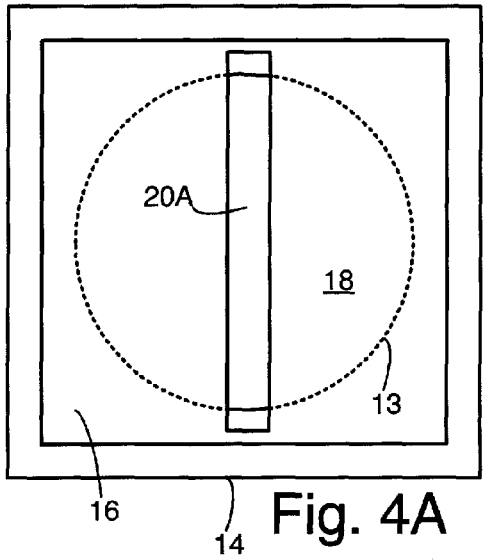
FIGS. 4A-4D are front views of a loudspeaker.
Figure 4B:
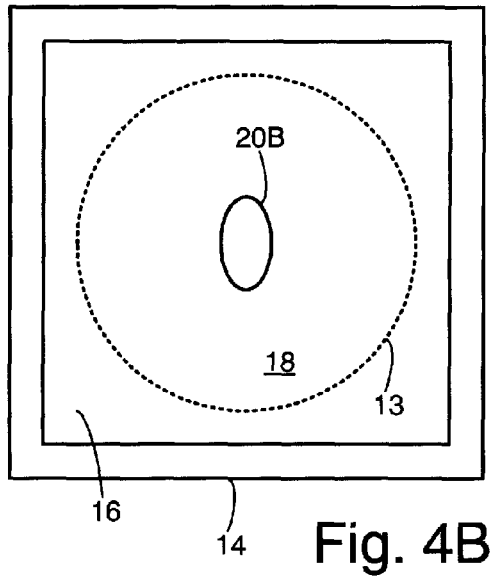
Figure 4C:
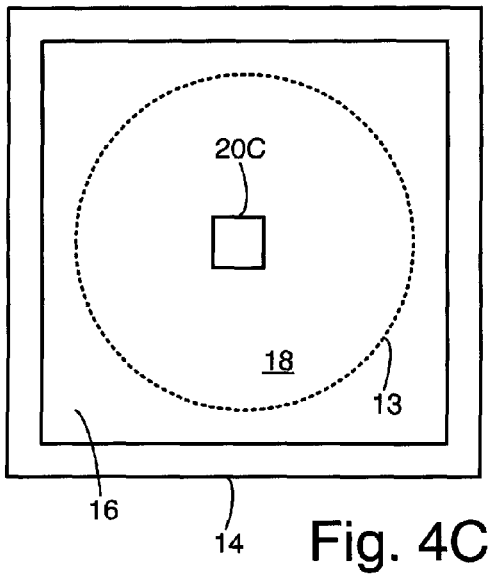
Figure 4D:
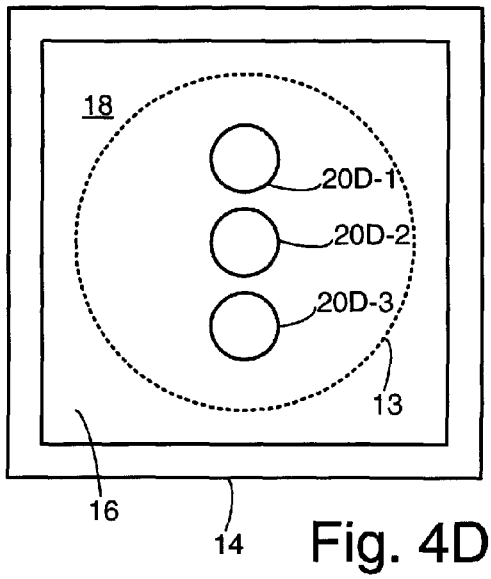
Figure 5:
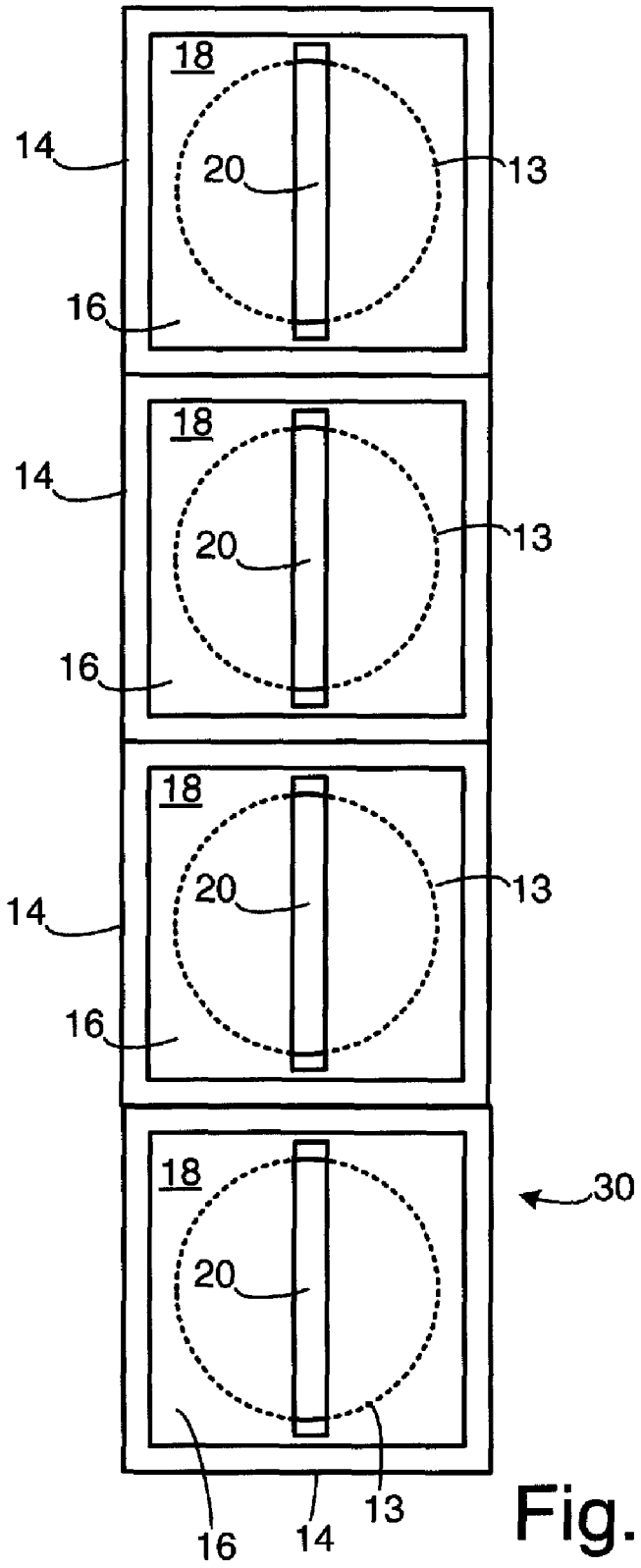
FIG. 5 is a front view of a line array loudspeaker.

The geometry of the aperture may be other than circular. For example, FIG. 4A shows a sheet 18 with a slotted aperture 20A. The slotted aperture 20A may be 1.2 cm wide and substantially the height of the sheet. A loudspeaker arrangement with a sheet such as the sheet of FIG. 4A may be particularly useful if the loudspeaker is arranged with other similar loudspeaker units in a line array 30, for example as shown in FIG. 5. FIG. 4B shows a sheet 18 with an oval aperture 20B. FIG. 4C shows a sheet 18 with a square aperture 20C. FIG. 4D shows an arrangement with a plurality of apertures, 20D-1-20D-3. Other variations could include star shaped or irregular shaped holes.

Figure 6A:
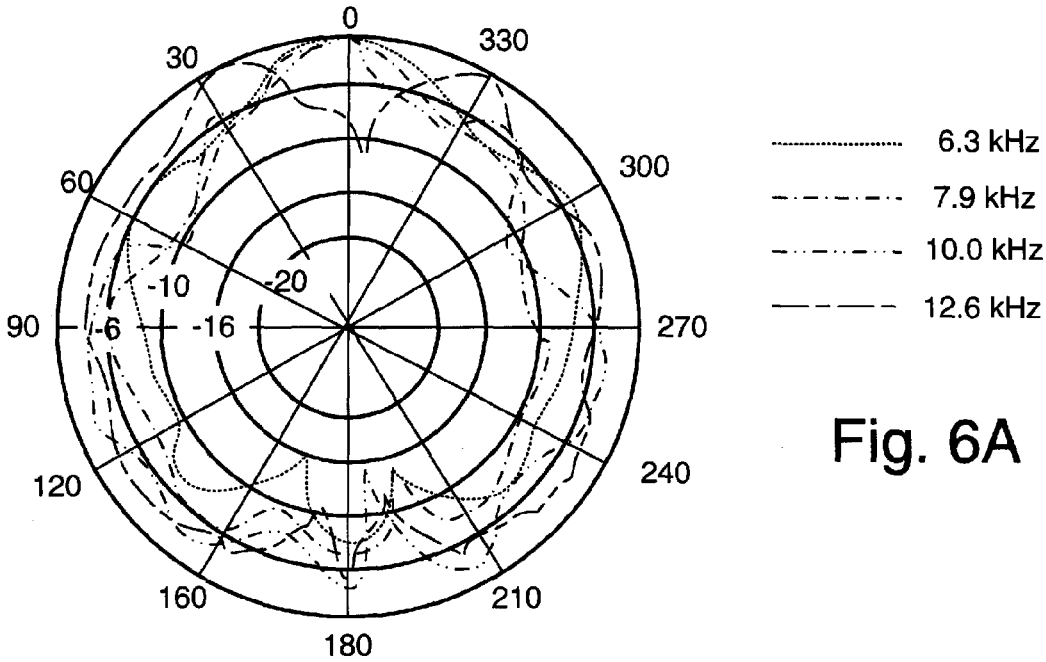

FIG. 6A shows the radiation pattern 30 of the same loudspeaker whose radiation pattern is shown in FIG. 1, with the sheet of FIG. 2B mounted 1.5 mm any moving surface of the acoustic driver. At frequencies of 6.3 kHz (5.4 cm wavelength, approximately equal to the diameter of the radiating surface), 7.9 kHz (4.3 cm wavelength, approximately 0.85 of the diameter of the radiating surface) and 10.0 kHz (3.4 cm wavelength, about 0.67 of the diameter of the radiating surface), the radiation at substantially all angles is within −10 dB of the maximum radiation. FIGS. 6B-6E show the radiation pattern at 6.3 kHz, 7.9 kHz, 10.0 kHz, and 12.6 kHz, respectively, without the sheet 18 (curves 32A-32D, respectively) and with the sheet of FIG. 2B (curves 34A-34D), respectively.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. A loudspeaker, comprising:
an acoustic device, comprising
an acoustic enclosure;
an acoustic driver, mounted in the acoustic enclosure; and
a sheet of compliant material with a aperture therethrough, mounted in the enclosure, between the acoustic driver and the environment, wherein the area of the aperture is less than half of the acoustic driver, the compliant sheet and the aperture configured so that less acoustic radiation of wavelengths close to or less than the diameter of the radiating surface is radiated on-axis and more acoustic radiation of wavelengths close to or less than the diameter of the radiating surface is radiated off-axis than is radiated by a loudspeaker with the same dimensions and without the sheet of compliant material.

2. The loudspeaker of claim 1, wherein the compliant material is neoprene foam.

3. The loudspeaker of claim 2, wherein the sheet is neoprene foam 0.32 cm to 2.54 cm thick.

4. The loudspeaker of claim 1, wherein the aperture is circular and has a diameter of between 1.27 cm and 2.54 cm.

5. The loudspeaker of claim 1, wherein the aperture is non-circular.

6. The loudspeaker of claim 5, wherein the aperture is square.

7. The loudspeaker of claim 5, wherein the aperture is rectangular.

8. The loudspeaker of claim 7, wherein the aperture is an rectangle elongated vertically.

9. The loudspeaker of claim 8, further comprising a second acoustic device positioned above the first acoustic device, the acoustic device comprising:
a second acoustic enclosure;
a second acoustic driver, mounted in the second acoustic enclosure; and
a second sheet of compliant material with a second aperture therethrough, mounted in the enclosure between the second acoustic driver and the environment, wherein the second aperture is a rectangle elongated vertically.

10. The loudspeaker of claim 1, wherein the sheet of material is dimensioned and configured so that there are open slots between the edge of the sheet and the enclosure through which low frequency acoustic energy can be radiated.

11. The loudspeaker of claim 1, wherein the sheet causes the acoustic driver to radiate proportionately less acoustic energy in the axial direction and proportionately more acoustic energy in off-axis directions than without the sheet.

12. The loudspeaker of claim 1, comprising a plurality of apertures through the sheet.

13. The loudspeaker of claim 1, the acoustic driver comprising a linear motor and a diaphragm, coupled to the linear motor so that the diaphragm vibrates along an axis passing through the aperture.

14. The loudspeaker of claim 1, the acoustic driver comprising a radiating surface, the acoustic driver further comprising a dust cover connected to the radiating surface, the dust cover having a diameter, wherein the diameter of the aperture is less than the diameter of the dust cover.

15. The loudspeaker of claim 1, wherein the sheet is formed so that the distances from all points on the radiating surface to the sheet measured in a direction parallel to the axis of the acoustic driver are substantially the same.

16. The loudspeaker of claim 1, wherein the sheet has a thickness of less than half the diameter of the aperture.

17. The loudspeaker of claim 1, further comprising an acoustic lens between the sheet and the environment.

18. The loudspeaker of claim 1, wherein the radiating surface of the acoustic driver and the aperture are both circular and wherein the diameter of the opening is less than one fourth the diameter of the radiating surface of the acoustic driver.

19. The loudspeaker of claim 1, wherein the cross sectional area of the opening is less than 0.1 times the cross sectional area of the acoustic driver.

20. An array loudspeaker comprising:
a plurality of acoustic drivers;
each of the plurality of acoustic drivers comprising a sheet of compliant material having a vertical slot shaped aperture therethrough, between the each of the plurality of acoustic drivers and the environment, the aperture having a cross sectional area less than 0.1 times the cross sectional areas of the each of the acoustic drivers so that less acoustic radiation of wavelengths close to or less than the diameter of the radiating surface is radiated on-axis and more acoustic radiation of wavelengths close to or less than the diameter of the radiating surface is radiated off-axis than is radiated by a loudspeaker with the same dimensions and without the sheet of compliant material.

* * * * *